US010835027B2

(12) United States Patent
Shary et al.

(10) Patent No.: US 10,835,027 B2
(45) Date of Patent: Nov. 17, 2020

(54) BRUSH HEAD FOR USE WITH FLOOR CLEANING MACHINE

(71) Applicant: THE MALISH CORPORATION, Willoughby, OH (US)

(72) Inventors: Kenneth L. Shary, Twinsburg, OH (US); Patrick J. Kelley, Willoughby, OH (US); Yongxing Yan, An Shun (CN); Zhiman Zhuo, Su Zhou (CN)

(73) Assignee: THE MALISH CORPORATION

( * ) Notice: Subject to any disclaimer, the term of this patent is extended or adjusted under 35 U.S.C. 154(b) by 60 days.

(21) Appl. No.: 16/073,669

(22) PCT Filed: Jan. 29, 2016

(86) PCT No.: PCT/CN2016/072822
§ 371 (c)(1),
(2) Date: Jul. 27, 2018

(87) PCT Pub. No.: WO2017/128307
PCT Pub. Date: Aug. 3, 2017

(65) Prior Publication Data

US 2019/0029408 A1 Jan. 31, 2019

(51) Int. Cl.

| | |
|---|---|
| ***A46B 9/06*** | (2006.01) |
| ***A47L 11/14*** | (2006.01) |
| ***A47L 11/08*** | (2006.01) |
| ***A46B 9/02*** | (2006.01) |

(52) U.S. Cl.
CPC ..... *A46B 9/06* (2013.01); *A46B 9/02* (2013.01); *A47L 11/08* (2013.01); *A47L 11/14* (2013.01); *A46B 2200/3033* (2013.01)

(58) Field of Classification Search
CPC ..... A46B 9/06; A46B 9/02; A46B 2200/3033; A47L 11/08; A47L 11/14
See application file for complete search history.

(56) References Cited

U.S. PATENT DOCUMENTS

| | | | | |
|---|---|---|---|---|
| 3,315,296 A * | 4/1967 | Richardson | A47L 13/24 15/159.1 |
| 4,037,369 A | 7/1977 | Campbell | |
| 4,042,995 A * | 8/1977 | Varon | A46B 3/005 15/142 |
| 4,763,377 A * | 8/1988 | Madsen | B25G 3/04 15/144.2 |
| 6,021,540 A * | 2/2000 | Miller | A46B 9/06 15/160 |

(Continued)

FOREIGN PATENT DOCUMENTS

| | | |
|---|---|---|
| CN | 202566876 U | 12/2012 |
| CN | 203792122 U | 8/2014 |
| CN | 104080366 A | 10/2014 |

(Continued)

*Primary Examiner* — Dung Van Nguyen
(74) *Attorney, Agent, or Firm* — Vorys, Sater, Seymour and Pease LLP; Scott M. Guttman

(57) ABSTRACT

A floor brush for using with floor cleaning equipment and, more specifically, a brush head (1) having distinct zones of varying bristle tuft (41) arrangements and configurations is provided. The brush head (1) is adapted for detachable connecting to a floor maintenance machine which is utilized for cleaning, burnishing, buffing and polishing a work surface such as a floor or the like.

20 Claims, 10 Drawing Sheets

(56) References Cited

U.S. PATENT DOCUMENTS

| | | | | |
|---|---|---|---|---|
| 6,370,724 | B1 * | 4/2002 | Holmes | A46B 5/06 15/111 |
| 8,402,590 | B1 * | 3/2013 | Larson | A46B 9/025 15/160 |

FOREIGN PATENT DOCUMENTS

| | | | |
|---|---|---|---|
| CN | 204148178 | U | 2/2015 |
| CN | 104869865 | A | 8/2015 |
| WO | 1985/02522 | A1 | 6/1985 |

* cited by examiner 36
53
51
50
51
31S
31L
31S
36
31
31

51
51
51
36

31S
31L
36

BRUSH HEAD FOR USE WITH FLOOR CLEANING MACHINE

This application is a National Stage of International Application No. PCT/CN2016/072822, filed Jan. 29, 2016, which is incorporated by reference herein in its entirety.

FIELD OF THE INVENTION

The present subject matter is related to floor cleaning equipment and, more specifically, a brush head having a unique bristle configuration, the brush head adapted for detachable connection to a floor maintenance machine of the type utilized for cleaning, burnishing, buffing and polishing a work surface such as a floor or the like.

BACKGROUND OF THE INVENTION

The present subject matter relates to floor maintenance machines and, specifically, to the construction of a new and novel brush head device adapted for detachable connection to a floor maintenance machine of the type particularly suited for use in residential, commercial, institutional and industrial floor maintenance applications such as cleaning, buffing, burnishing and polishing. In such machines, a series of cleaning pads are typically utilized having various abrasive characteristics that are rotated upon actuation of the machine to perform various maintenance operations including buffing, burnishing, spray-buffing, polishing, and the like. These cleaning pads are detachably mounted on the pad holder via a series of polymeric (plastic) hook and loop bristles. These pad-type cleaning systems have many important draw backs. For example, these cleaning pads lose their abrasive characteristics and tend to wear out after multiple work applications, thereby rendering them unsuitable for continued use in their intended application. Also, these cleaning pads are not proficient in cleaning uneven floors with deep recesses, such as deep grouts or contoured tile. Further, these cleaning pads are not easy to use as they are oftentimes difficult to center and maintain in proper functional position during relatively high-speed operations on irregular or non-smooth surfaces. Moreover, these cleaning pads are difficult to clean and maintain, and are relatively time consuming and expensive to replace.

Therefore, there is a need for a brush head that will not only allow for the easy maintenance of a work surface or floor, especially one with deep grouts or contours, but for a device that is easy to use, reliable in performance and relatively inexpensive to produce and maintain

SUMMARY OF THE INVENTION

Presently disclosed are embodiments of a brush head case with a floor surface machine. In one embodiment, the brush head comprises a brush block having a mounting side capable of attachment to a floor surface machine, a bristle side having a balanced bristle arrangement with respect to an axis of the block, and a periphery. The bristle side has a plurality of sites for receiving bristle tufts, as well as an inner region, an intermediate region, and an outer region. The bristle side's inner region has a set of first bristle tufts, divided by the primary reference axis, and the inner region bristle tufts have a first set of characteristics. The bristle side's intermediate region has a set of second bristle tufts located outbound of and divided by the inner region, and the intermediate region bristle tufts have a second set of characteristics, at least one of which is different from the first set of characteristics. The bristle side's outer region has a third bristle tufts located outbound of and divided by the intermediate region bristle tufts, and the outer region bristle tufts have a third set of characteristics.

BRIEF DESCRIPTION OF THE FIGURE

FIG. 6*a* depicts a top view of the block's bristle side with bristles, whereas

DETAILED DESCRIPTION

Figure 1:
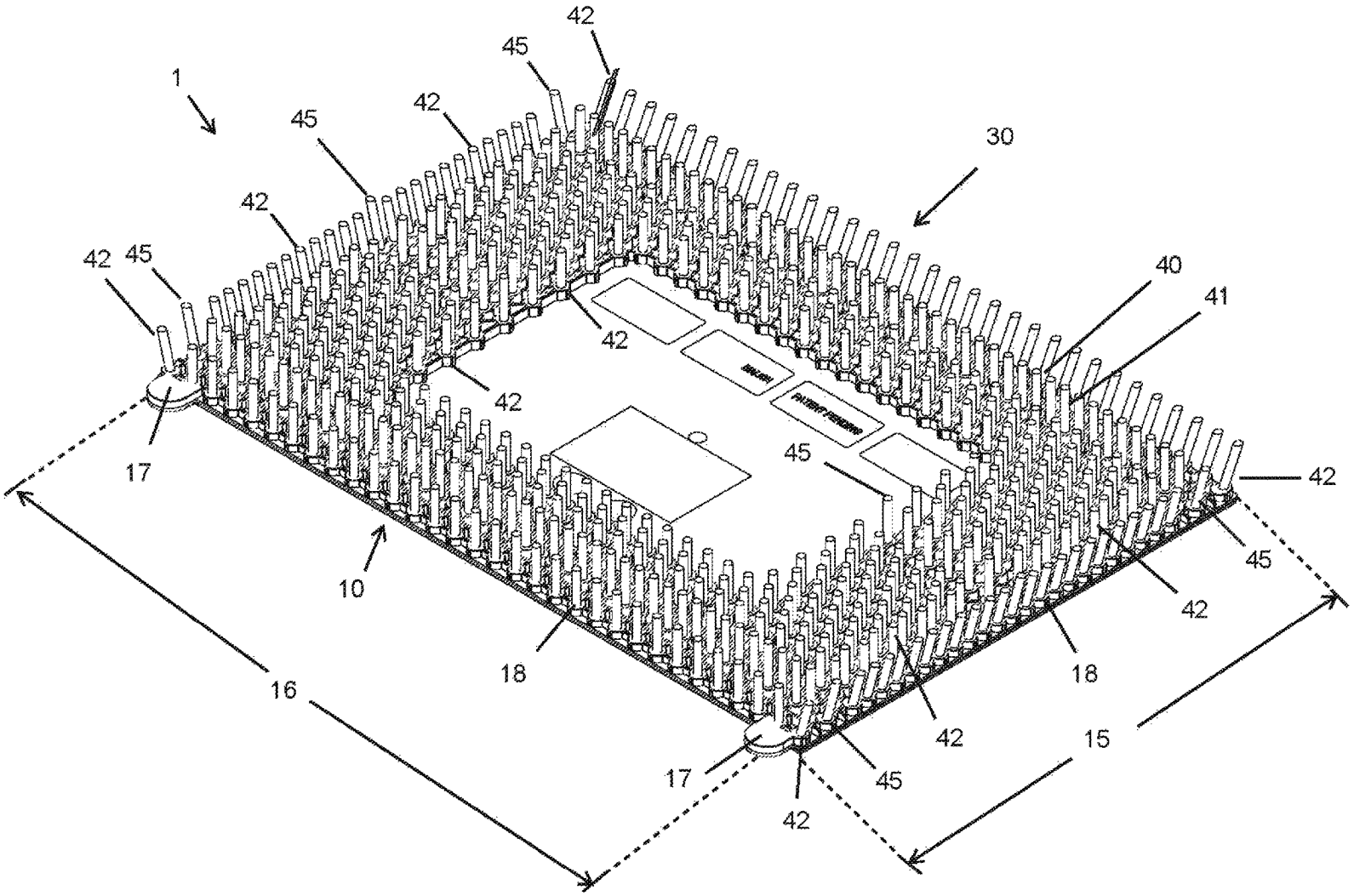
FIG. 1 is an isometric view of an embodiment of the floor brush.

The terms "about" or "substantially" as used herein refers to a quantity, level, value, dimension, size, or amount that varies to some extent based on the context in which it is used. For example, such variation can be by as much as 10%. At the least, each numerical parameter can be construed in light of the number of reported significant digits and by applying ordinary rounding techniques. It will be appreciated by one skilled in the art that all numerical parameters presented herein may vary by as much as plus or minus 10%, regardless of whether the numerical parameter is preceded by the word "about," "substantially," or an equivalent term.

It should be understood that the terms "a" and "an" as used above and elsewhere herein refer to "one or more" of the enumerated components. It will be clear to one of ordinary skill in the art that the use of the singular includes the plural unless specifically stated otherwise. Therefore, the terms "a," "an" and "at least one" are used interchangeably in this application. For example, "a" bristle refers to both one bristle or a group comprising two or more bristles.

Unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims approximations that may vary depending upon the desired properties sought to be obtained.

Throughout the application descriptions of various embodiments use "comprising" language; however, it will be understood by one of skill in the art, that in some specific instances, an embodiment can alternatively be described using the language "consisting essentially of" or "consisting of."

For the purpose of clarity, any element or feature of any method or composition described herein can be combined with any other element or feature of any other method or composition described herein.

Referring generally to FIGS. 1-10, exemplary brush heads are disclosed. As described herein, the brush head 1 may be mounted to an oscillating floor cleaning machine (not shown), such as a buffer or burnisher. For purpose of illustration, the disclosed brush head 1 is mounted to such a machine and described in use on tile floor with deep grout grooves. In operation, these floor cleaning machines to which the brush head 1 is mounted are guided by a user and, therefore, may have a leading end that faces the direction the user is guiding the machine, as well as a trailing end that faces the user who is pushing the machine. It will be understood, however, that the disclosed brush head 1 may be mounted to other drive equipment and utilized on any floor surface, regardless of whether such surface is substantially planar or, on the other hand, is contoured or uneven, with or without grooves. By way of non-limiting example, the floor machines to which brush head 1 may be mounted include those manufactured by Square Scrub® (such as the Doodle Scrub®, the EBG-20/C, and/or the EBG-28), as well as those floor machines manufactured by Hawk Enterprises and Koblenz®.

Figure 2:
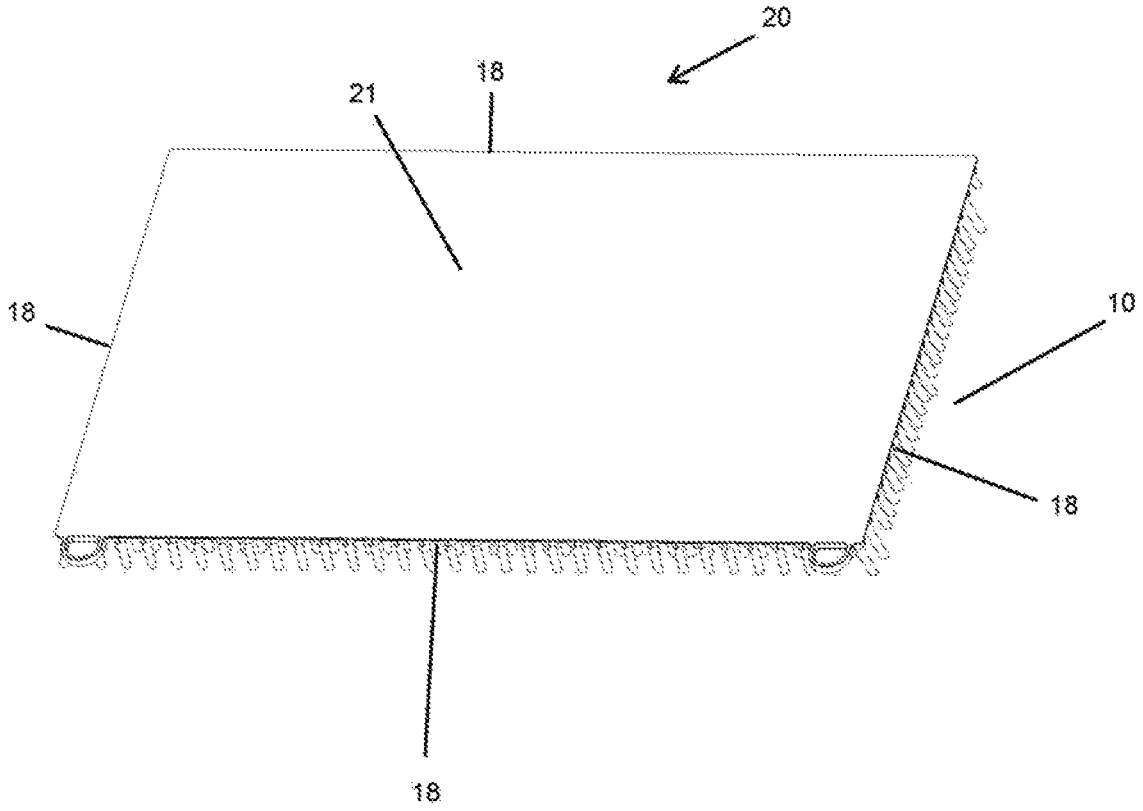
FIG. 2 is an isometric view of the block's mounting side.
Figure 3:
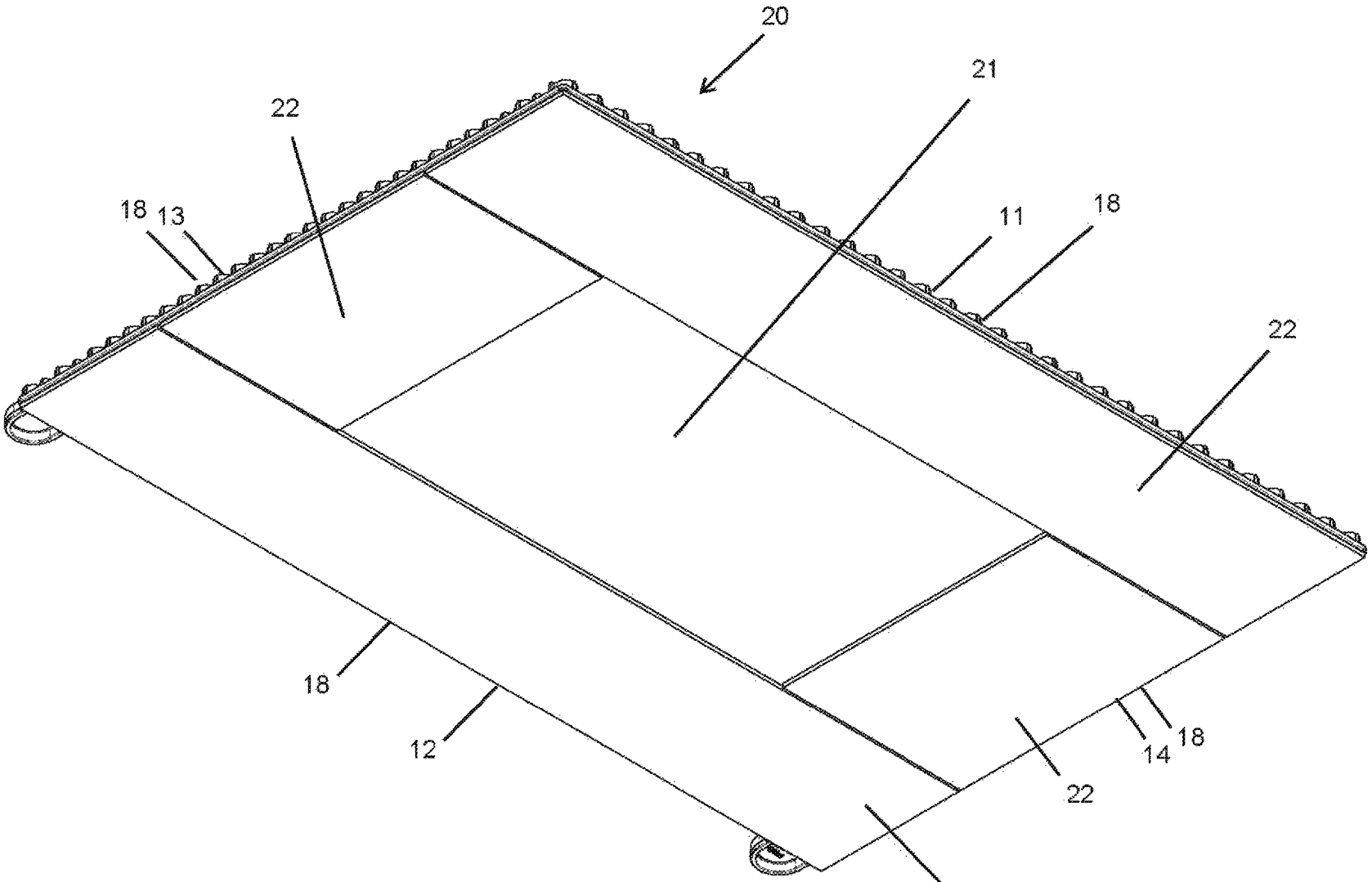
FIG. 3 is an isometric view of one embodiment of the block's mounting side.

Referring to FIGS. 1-4, an exemplary brush head 1 is illustrated. Brush head 1 is comprised of block 10. As depicted, block 10 has a top mounting side 20, bottom side 30 (i.e., a bristle side), and a periphery 18 disposed there between (i.e., an exterior, which may comprise outer walls). Bristle side 30 is illustrated in FIG. 1, whereas mounting side 20 is illustrated in FIGS. 2-3.

As depicted in FIGS. 2-3, top side or mounting side 20 may comprise a mounting or mating surface 21, whereby brush head 1 may be connected to a floor cleaning machine, in this exemplary embodiment, mounting side 20 and mating surface 21 are substantially planar and flat; however, other surface configurations may be utilized depending on the machine to which brush head 1 will be mounted. FIG. 3 depicts an embodiment where mating surface 21 comprises sheets hook and loop material, such as Velcro®. For example, mating surface 21 may comprise loop material 22 that is configured to interlock with a hook material disposed underneath, for example, a cleaning machine. Loop material 22 may be installed on top sides differently than arranged in the exemplary embodiment of FIG. 3. It will be understood, however, that the disclosed mating surface 21 may comprise other means for connecting block 10 to a piece of drive equipment. By way of non-limiting example, these mating means include the use of magnets, adhesives, ridges and mating grooves (e.g., dovetail joints), and fasteners, such as pins, bolts, straps.

Figure 4:
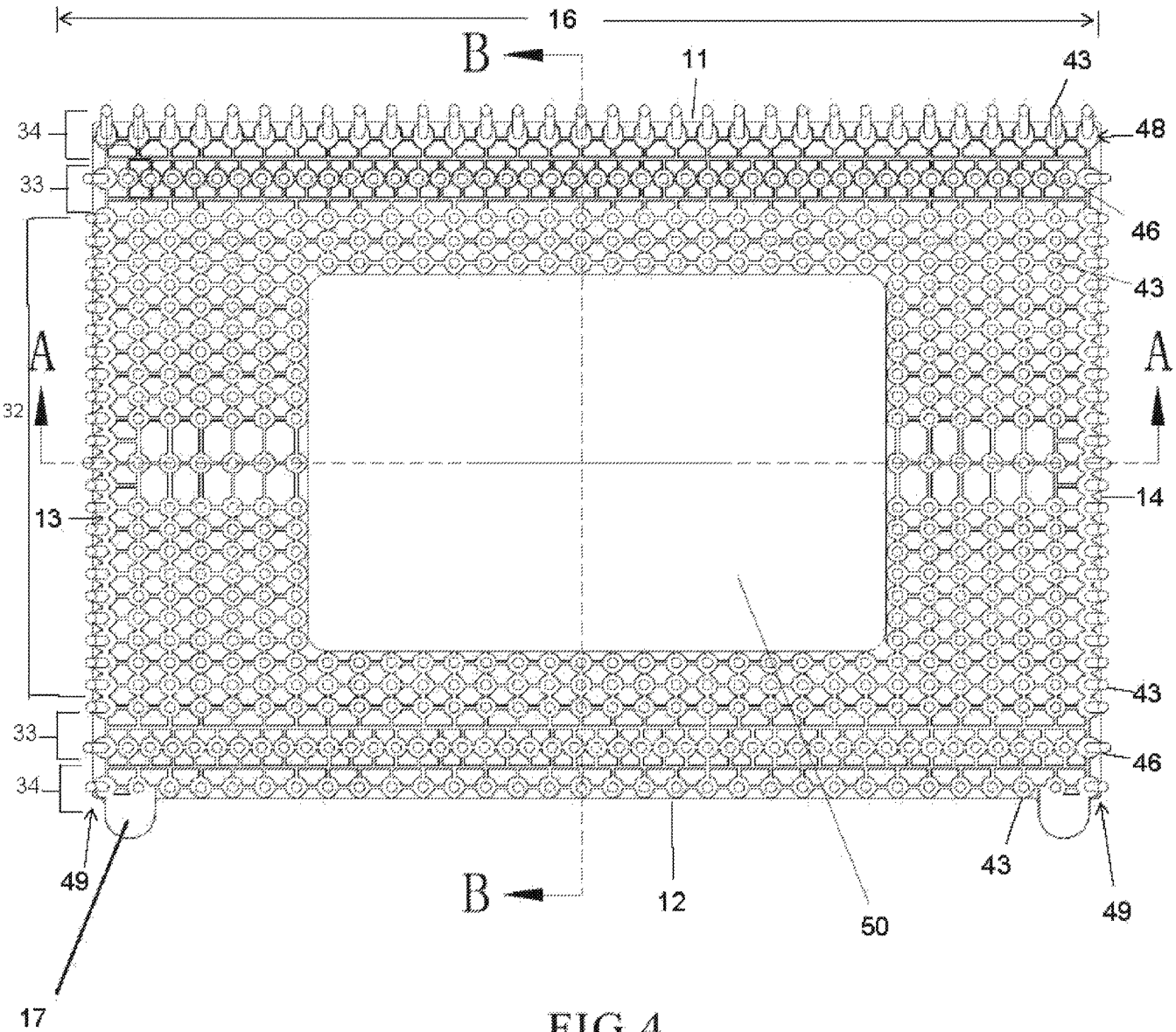
FIG. 4 is a top view of the block's bristle side.

FIG. 4 illustrates how in some embodiments periphery 18 comprises the walls extending from leading edge 11, trailing edge 12, and opposing side edges 13 and 14. Block 10 may also have several point of reference axis running therethrough. For example, FIG. 4 depicts 2 reference axis of block 10 labeled as A-A and B-B; however, it should be appreciated that any number of other reference axes may be drawn on bristle side 30 of block 10 as a point of reference. Here, axis A-A extends through the width of the block 10 parallel to and equidistant from leading edge 11 and trailing edge 12, whereas axis B-B extends through the length of block 10 parallel to and equidistant from side edges 13 and 14. Thus, reference axis A-A and B-B are centrally located and divide the bristle surface 30 into two equal halves, however, other primary reference axis need not equally divide surface 30. Thus, it will be appreciated that block 10 may comprise countless other central/primary reference axes that may be differently disposed/oriented than as depicted in FIG. 4.

Any suitable manufacturing method may be utilized to construct block 10 of brush head 1. For example, block 10 may injection molded or machined to its desired dimensions. Further, block 10 may be constructed from any suitable material, including thermoplastic polymers such as polypropylene, acrylonitrile butadiene styrene (ABS) or nylon. It should be appreciated that block 10 may be constructed from other materials such as ceramics, metals, and/or composites. However, brush head 1 will weigh less than 5 pounds (2.27 kg) so as to effectively clean floor surfaces when mounted to oscillatory floor surface equipment.

FIGS. 1-10 generally depict exemplary embodiments of brush head 1 wherein block 10 has rectangular geometry with substantially flat/planar mounting and bristle side 20 and 30 surfaces. Where geometries are utilized having corners (such as the rectangular embodiment), the corners may be beveled or rounded. It will be understood, however, that block 10 of brush head 1 may comprise other geometries such as circular, oval, square, or trapezoidal. For example, brush head 1 may instead be disk shaped, which would allow its use on a rotary floor machine adapted to receive disk shaped pads or brushes.

In the present example, the length 15 of block 10 is measured as the distance between its leading edge 11 and its trailing edge 12. Similarly, the width 16 of exemplary block 10 is measured as the distance between its side edges 13 and 14. It should be noted, however, that block 10 may have a wide range of dimensions. In one example, block 10 has a width of roughly 497.6 mm (19.59 inches) and a length of roughly 338.20 mm (13.31 inches). Thus, in this example, block 10 has a surface area of roughly 168,289.97 square mm (260.85 square inches) Moreover, the thickness of block 10 may range from 1 mm to 25 mm (i.e., 0.04 inches to 0.98 inches), and in one example, the block's 10 thickness is 7 mm (0.27 inches). These are non-limiting examples, however, as block 10 may be dimensioned as needed to fit any style oscillatory floor surface machine and as needed by the particular application. Thus, one skilled in the art will appreciate that the brush head's 1 dimensions may be scaled up or down relative to the corresponding machine's weight size, and/or power. For example, in applications where brush head 1 is mounted to a mini-scrubber machine such as the Doodle Scrub®, which weighs 9.98 kg (22 pounds) and has dimensions of 133.35 mm (5.25 inches) by 2661 mm (10.5 inches), the dimensions of brush head 1 would be proportionately reduced to operably mount thereto. Similarly, the dimensions of brush head 1 may be proportionately increased to be operably mounted to larger floor machines.

In use, mounting side 20 is mounted to a piece of cleaning equipment via mating surface 21. In embodiments having a leading edge 11 and trailing edge 12, the block 10 is aligned with the piece of cleaning equipment so that leading edge 11 and trailing edge 12 are aligned with the equipment's leading end trailing end, respectively. Brush head 1 may also comprise a means for aligning, installing, and uninstalling brush head 1 with respect to a floor cleaning machine. For example, FIGS. 1-10 depict exemplary embodiments where block 10 comprises two tabs 17 that facilitate the alignment, installation, and removal of brush head 1 with respect to a piece of cleaning equipment. In these exemplary embodiments, tabs 17 are disposed along trailing edge 12; however, it will be appreciated that tabs 17 may be disposed elsewhere along the perimeter or periphery of the block 10. Moreover, it will be appreciated that more or less than two tabs 17 may be utilized, and that other means may be utilized to aid in the alignment, installation, and removal of brush head 1 from a piece of drive equipment.

Generally speaking, the bottom side 30 (i.e., the bristle side) comprises a plurality of bristles 40 that extend perpendicularly therefrom. Bristles 40 may be of any diameter suitable for a particular application. FIGS. 1-6 illustrate an example embodiment where two types of bristles 40 are utilized: short bristles 42 and long bristles 45. Accordingly, for purposes herein, the term bristles 40 is a general term that includes various types of bristles, including short bristles 42 and long bristles 45. In this embodiment, both types of bristles 40 provide a cleaning/scrubbing feature; however, short bristles 42 also provide upright support for a floor machine, whereas long bristles 45 also enable brush 1 to clean deep grout grooves and capture and retain moisture, liquids, etc. In some embodiments, long bristles 45 (or tufts 46) are replaced with other elements, projections or protrusions, any of which are capable of providing the deep cleaning feature as long bristles 45 (or tufts 46).

Generally, bristles 40 may be made from any number of materials, including but not limited to synthetic, abrasive, and natural fibers, or any other similar material. In one specific example, short bristles 42 are made from polypropylene whereas long bristles 45 are made of nylon. However, in other non-limiting examples, short bristles 42 may be made of polyester or abrasive filaments like Tynex®, whereas long bristles 45 may be made of polyester, polypropylene, Tynex® fibers. It will be appreciated, however, that any number of other filaments and/or materials may be utilized for short bristles 42, so long as that material provides a rigid and firm bristle 42 capable of supporting the system (as discussed below). Further, bristles 40 (both short and long bristles 42 and 45) may have any type of surface finish or be coated with a material. For example, any of the bristles 40 may be coated with an abrasive coating or other coating having certain characteristics. One non-limiting example would be the use of Tynex® coated fibers. Alternatively, bristles 40 may have a specific shape/geometry or surface finish, such as crimping, perforating, etc., which may allow the bristles to collect and retain moisture, and/or perform other functions that may be desirable in a given application. In this example, long bristles 45 are crimped; however, this is optional, and short bristles 42 may optionally be crimped as well.

In the exemplary embodiments depicted herein, bristles 40 are arranged or bundled into tufts 41. More specifically, in these embodiments short bristles 42 and long bristles 45 are arranged as short bristle tufts 43 and long bristle tufts 46, respectively. These tufts 41 (as well as tufts 43 and 46) are all illustrated in the figures as cylinders extending from bottom side 30. It will be appreciated that each of these tuft 41 "cylinders" represents a plurality of bristles 41 (i.e., bristles 42 and 45). As used herein, the term tufts 41 includes both short bristle tufts 43 and long bristle tufts 46. Also in these embodiments, the short bristle tufts 43 support the brush head 1 and a machine mounted thereto in an upright position, both while in use and not in use. Thus, short bristles 42 should be rigid and firm so that when they are bundled into a plurality tufts 43 and mounted to bristle side 30, they are capable of providing such support without significant deformation and/or premature wear (i.e., short bristles 42 in short tufts 43 remain in a substantially extended position with loading so as to resist permanent deformation). Also in this embodiment, the long bristle tufts 46 are arranged in various rows located on the bristle side 30. These exemplary long bristle tufts 46 may include crimped long bristles 45, which allows them to gather and collect moisture. It will be appreciated, however, that crimping is optional, and that any or all of tufts 41 may contain bristles 40 that have any number of finishes, coatings, or surface finishes, such as crimping.

Figure 6C:
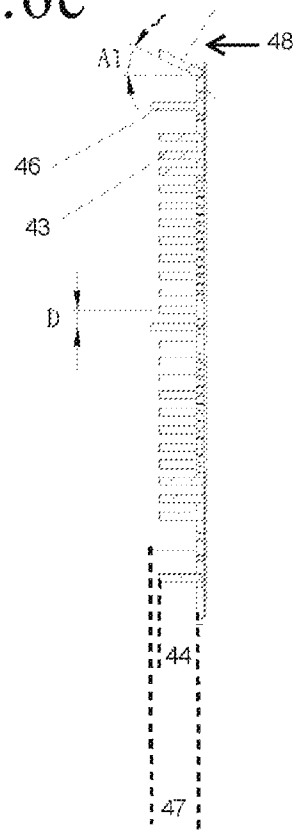
FIGS. 6*b* and 6*c* depict side views of the block taken along axis A-A and B-B, respectively.

Bristles 40 and tufts 41 may have a wide range of dimensions. For example, FIG. 6*c* depicts tufts 41 having a short tufts trim height 44 that is shorter than the long tuft trim height 47. Here, trim height is the distance measured perpendicularly from the bristle/bottom side's 30 surface to the end/tip of any particular bristle 40 or tuft 41. Trim heights 44 and 47 may have range from 5 mm (0.20 inches) to 75 mm (2.95 inches). In one example, trim heights 44 and 47 are 23.5 mm (0.92 inches) and 28.5 mm (1.12 inches); however, other trim heights 44 and 47 may be utilized.

The number of bristles 40 per individual tuft 41 will depend upon the requirements of any particular application and the method by which bristles 40/tufts 41 are mounted to bristle side 30. For example, it may be desirable in a certain application to have bristle tufts of a particular density, geometry, shape, etc. Also, as mentioned below, various mounting methods may be utilized to secure bristles 40/tufts 41 to bristle side 30, such as fusion, epoxy set, staple set, or anchor set. In the examples utilizing staple or anchor set mounting, one tuft 41 of bristles 40 may comprise four individual bristle 40 strands that are folded in half and mounted into block 10 so as to yield a tuft of 8 bristles; however, fusion and epoxy set mounting methods would not require this folded bristle 40 arrangement. For purposes of the below discussion, brush head 1 is described as containing tufts 41 (and tufts 43 and 46) rather than bristles 40 (and bristles 42 and 45); however, it should be appreciated that bristles 40 need not be organized and arranged as tufts 41.

FIGS. 1-6 also depict an embodiment where tufts 41 are arranged and organized on bristle side 30 into a plurality of rows. These rows may be staggered with respect to one another (see FIGS. 1 and 5), or not staggered (see FIG. 4). It will be appreciated, however, that other arrangements, organizations, and/or patterns of tufts 41 may be utilized. For example, tufts 41 may be arranged into a pattern that does not comprise rows.

As mentioned above, at least some of the bristles 40 and/or tufts 41 will support the brush head 1, as well as any machine mounted thereto, in an upright position. Thus, bristle 40 and tuft 41 selection, design, and arrangement is important as at least some of them must be capable of supporting the weight of the brush head 1 when mounted to a machine without excessive, premature, and/or uneven deformation and wear. Further, the weight of the machine and brush head 1 should be evenly distributed throughout bristle side 31 and amongst the weight bearing bristles 41/tufts 41, as uneven load distribution will result in uneven wearing of the bristles 40/tufts 41, which in turn may decrease cleaning effectiveness, cause the machine to not remain upright (whether in use or not), and necessitate premature brush replacement. Thus, the bristles 40/tufts 41 should be disposed on bristle side 30 in a balanced arrangement with respect to a reference axis. For example, FIG. 4 depicts tufts 41 being balanced with respect to a central axis A-A. In fact, FIG. 4 depicts an example where tufts 41 are also balanced with respect to a second central axis B-B. An example of a balanced bristle arrangement or distribution is a symmetrical bristle pattern; however, non-symmetrical balanced bristle 40/tuft 41 arrangements may be also utilized. Thus, bristles 40 /tufts 41 have a number of variables, including their anchoring, arrangement, design (material type and/or dimensions such as diameter and length), geometry, organization, orientation, placement, rigidity, surface finish, shape, etc.

Figure 5:
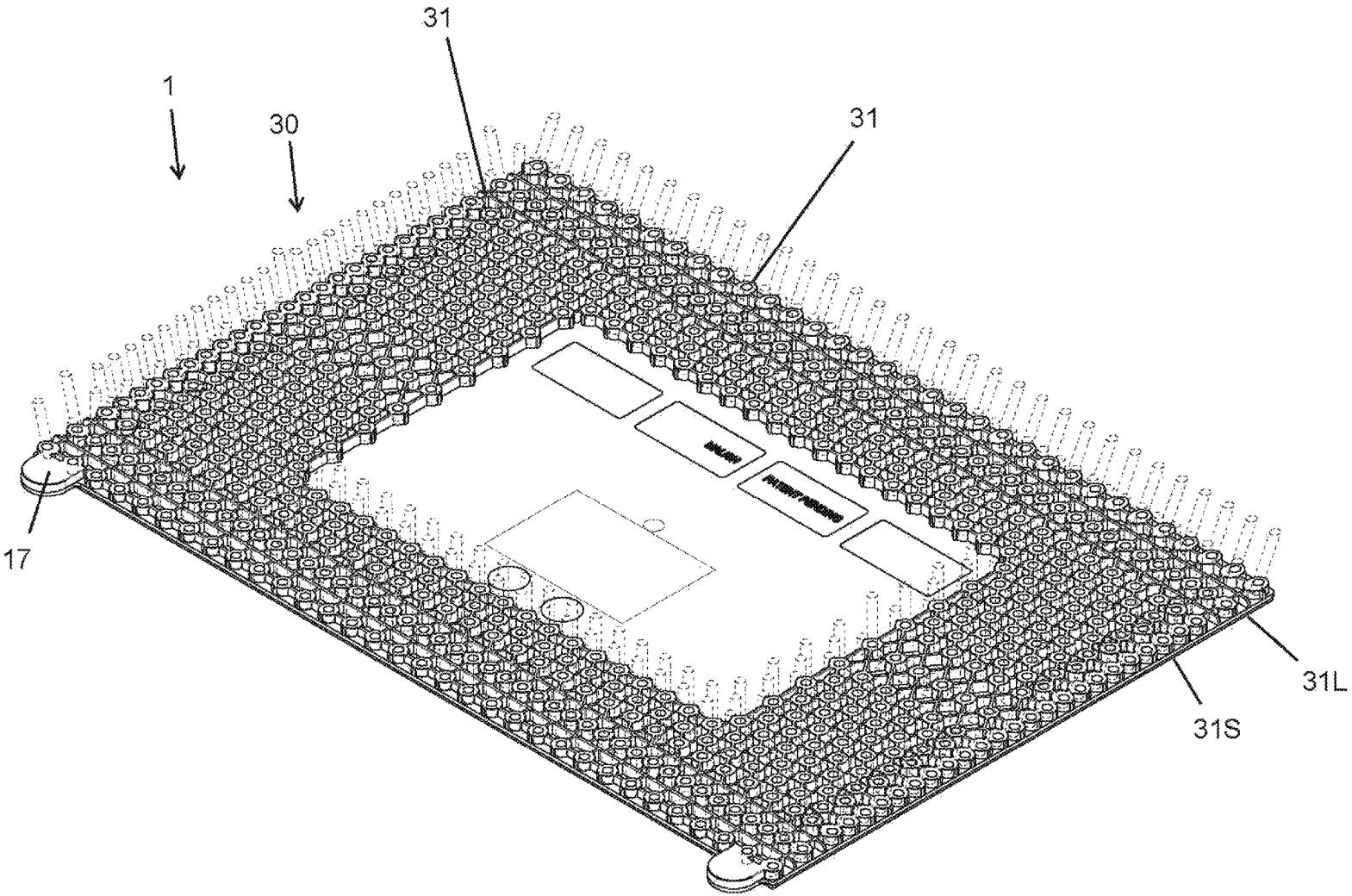
FIG. 5 is an isometric view of the block's bristle side without bristle tufts.
Figure 6A:
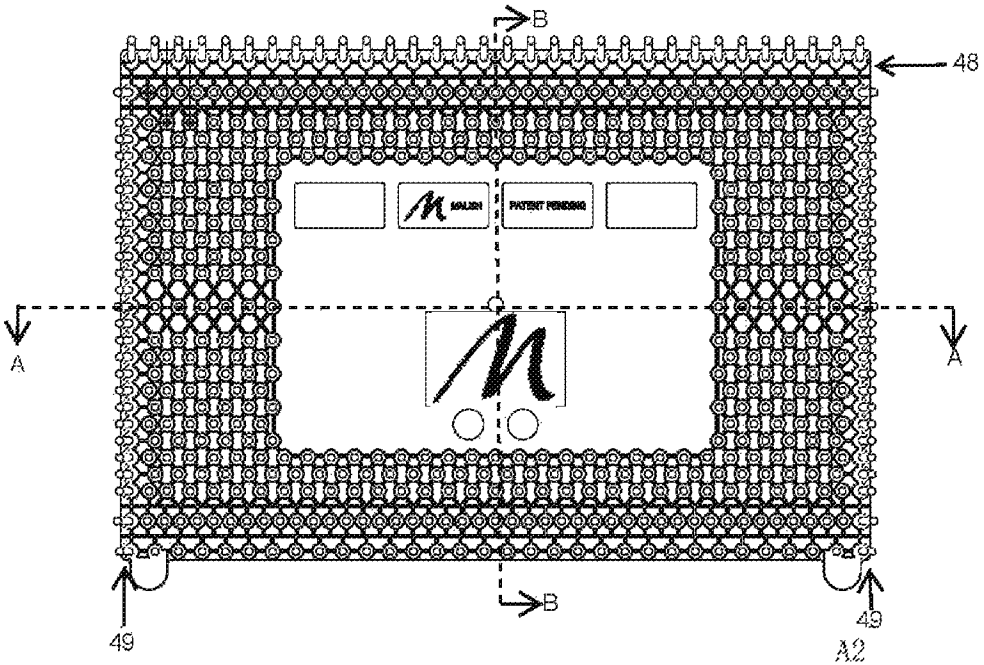
Figure 6B:
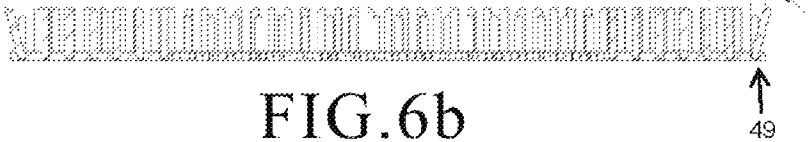

The figures depict embodiments where bristles 40 are arranged as tufts 41 (i.e., tufts 43 and 46), where each such tuft 41 is be mounted within a corresponding tuft site 31. Tuft sites 31 are apertures or holes, which are configured to receive a bristle tuft 41. In these embodiments, FIGS. 4-6 illustrate how bristle side 30 may comprise an array, matrix, or plurality of tuft sites 31, the number of which will depend upon the size of the bristle side 30 and the particular application. Each tuft site 31 configured to receive a tuft 41 of bristles (whether short bristle tuft 43 or long bristle tuft 46). For example, tuft sites 31L are intended for long bristle tufts 46 and therefore may be configured, designed, and dimensioned differently than tuft sites 31S, which are intended for short bristle tufts 43. As with the tuft 41 patterns discussed above, sites 31 may be of any number of configurations or patterns. For example, any array or matrix of sites 31 may be staggered (see FIGS. 5, 6*a*, and) or not staggered (see FIGS. 4 and 9). A staggered configuration may take on a honey-comb like appearance. it will be appreciated that tuft holes 31 may be disposed on bristle side 30 in any number configurations and patterns, so long as they allow for a balanced bristle/tuft arrangement as discussed above. Thus, each tuft site 31 may have certain characteristics (i.e., arrangement, configuration, dimensions, geometry, pattern, etc.) depending on the tuft 41 type mounted therein. Tuft sites 31 may be dimensioned in a variety of ways. In embodiments having rows of both long and short bristle tufts 43 and 46, the length distance between the rows of tuft sites 31 may range from 11 mm (0.43 inches) to 28 mm (1.10 inches), whereas the distance between neighboring tuft sites 31 within a row may range from 10 mm to 16 mm (0.39 inches to 0.63 inches). In one non-limiting example, the row of long tuft sites 31L in intermediate region 33 is spaced 20 mm (0.79 inches) apart lengthways from the next parallel row of tuft sites 31 (which happen to be short tuft sites 31S) in either the inner region 32 or outer region 34; the rows of short tuft sites 31S in inner region 32 are spaced 11.1 mm (0.44 inches) apart lengthways; the distance between short tuft sites 31S within an individual row thereof ranges from 11.7 mm to 15.6 mm (0.46 inches to 0.61 inches); and the distance between long tuft sites 31L within an individual row ranges from 10.7 mm to 11 mm (0.42 inches to 0.43 inches). It will be appreciated that the foregoing numerical parameters, and ranges of the same, are merely approximates and any other "spacings" contemplated by someone of ordinary skill in the art are suitable.

As briefly mentioned above, bristles 40/tufts 41 may be mounted to bottom side 30 via any number of methods. For example, bristles 40/tufts 41 may be fused to bottom side 30 of block 10. Alternatively, tufts 41 may be mounted and secured within tuft sites 31 via staples (not shown). In another embodiment, tufts 41 are anchor set within tuft sites 31. However, it will be appreciated that other methods may be utilized to mount bristles 40 to the bottom side 30 of block 10 whether or not sites 31 are utilized.

While bristles 40/tufts 41 generally extend in a perpendicular direction from the bottom side 30 surface, some tufts 41 may optionally be angled/flared so as to extend away from block 10. Such angled/flared tuft 41 configurations may allow bristles/tufts to extend beyond the brush head's 1 footprint so that brush head 1 can lean difficult to reach floor areas, such as corners and areas abutting a wall. For this reason, it is most common to dispose flared tufts 41 along any or all of the block's 10 periphery 18; however, interior tufts 41 may also be flared depending on the application. Further, different segments of the peripheral bristles/tufts may be flared at different angles.

For example, FIG. 4, FIGS. 6*a*-6*c*, and FIG. 10 depict embodiments where some peripheral tufts 41 (i.e., tufts 41 located along periphery 18) are flared away from block 10 at an angle so as to extend beyond the brush head's 1 footprint. More specifically, these figures depict (i) a leading row of flared tufts 48 (along leading edge 11), which are flared at an angle A1; (ii) two side rows of flared tufts 49 (along sides 13 and 14), which are flared at an angle A2; and (iii) tufts 41 located along trailing side 12 are not flared. Theoretically, A1 and A2 (or any other flare angle) may be any angle(s) from 0 to 90 degrees; however, embodiments including flared peripheral tufts 41 typically use A1 and A2 values ranging from 5 degrees to 45 degrees. For example, in one embodiment A1 equals 26 degrees and A2 equals 15 degrees. Further, A1 and A2 may be equal in some embodiments. In other embodiments, flared peripheral side tufts 49 along side edges 13 and 14 are not flared at the same angle A2. For example, flared peripheral tufts along side 13 may be flared at a different angle than the flared peripheral tufts along side 14. In other embodiments, a row of tufts 41 bordering trailing side 12 is flared at an angle. Regardless, the illustrated configuration of flared bristle tufts constitutes one exemplary embodiment, and it will be appreciated that countless other configurations of flared bristle tufts, if any, may be utilized instead.

Where it is desirable to utilize tufts 41 that are flared, FIGS. 8*b*-8*e* depict how tuft sites 31 may be formed and oriented to flare a corresponding tuft 41. For example, tuft sites 31 located along the periphery 18 of the block 10 being formed at an angle, so that the tufts 41 inserted therein are angled/flared away from the block 10 as discussed above. In these examples, flared leading tuft sites 35 are formed at an angle so that the tufts 41 received therein are flared away from leading side 11. Also in these examples, flared side tuft sites 36 situated along sides 13 and 14 are formed at an angle so that the tufts 41 received therein are flared away from sides 13 and 14 respectively. Of course, the foregoing constitutes a non-limiting example, and other arrangements and configurations of flared tuft sites 41 may be appropriate.

As mentioned above, bristle side 30 has a plurality of tufts 41 extending therefrom and, in some embodiments, tufts 41 include short tufts 43 and long tufts 46. Short tufts 43 and long tufts 46 are made of different bristles (i.e., short bristles 42 and long bristles 45) and, therefore, each tuft type (i.e., tufts 43 and 46) has unique bristle characteristics as discussed above. Moreover, this plurality of tufts 41 may be arranged, organized, oriented, or patterned in any number of configurations throughout the surface of bristle side 30. Thus, bristle side 30 may be conceptualized as comprising various regions/zones of tufts, where each zone of tufts 41 has a set of characteristics that impact the brush head's 1 ability to clean various types of floor surface when in use with a floor surface machine. The set of characteristics for each zone of tufts comprises characteristics and variables, including but not limited to bristle/tuft type, arrangement, organization, orientation, pattern, or surface finish. FIGS. 1-10 generally depict exemplary embodiments of block 10 where bristle/bottom side 30 comprises three tuft regions: (i) an central/inner region 32 of tufts 41, (ii) an intermediate region 33 of tufts 41, and (iii) an outer region 34 of tufts 41.

Inner region 32, intermediate region 33, and outer region 34 are collectively referred to as the "Regions," and each is referred to as a "Region."

The Regions are best exemplified in FIG. 4. First, this example depicts exemplary locations of the Regions relative to each other. For example, FIG. 4 shows (a) the inner region 32 being located along and/or divided by (or straddling) an axis (e.g., axis A-A or B-B); (b) the intermediate region 33 being located outbound of and divided by the inner region 32 (or straddling the inner region 32) and (c) the outer region 34 being located outbound of and divided by the intermediate region 33 (or straddling the intermediate region 33). FIG. 4, however, exemplifies just one embodiment and the Regions may be disposed differently depending on their location with respect to a different axis.

Second, FIG. 4 depicts how each Region of tufts will have a set of characteristics that are defined by the type(s) of bristle tufts 41 (i.e., short tufts 43 and/or long tufts 46) and how that tuft 41 is disposed therein. For example, this figure depicts an embodiment wherein (i) the inner region 32 contains primarily short bristle tufts 43; however, it may optionally include long bristle tufts 46; (ii) the intermediate region 33 contains only long bristle tufts 46 that are crimped; and (iii) the outer region 34 contains only short bristle tufts 43. Thus, each Region may have different types of tufts 41 therein, where each type of tuft 41 will have specific/unique characteristics/variables depending on the type of bristle 40 bundled therein. These bristle/tuft specific characteristics/variables include, among others, arrangement, bundle type, dimensions, geometry, orientation surface finish, etc. Also, each Region may have a specific arrangement, combination, organization, or pattern of one or more types of tuft 41 that may or may not be unique to that Region. These arrangements, combinations, organizations, or patterns of tuft 41 type(s) are also characteristics/variables that may or may not be unique to a Region. Thus, each Region of tufts has a set of characteristics that depend on the type of bristle 40 utilized (in tufts 41), as well as the tufts' 41 arrangement, combination, organization, or pattern therein. Moreover, at least one characteristic in the intermediate region's 33 set of characteristics (S2) is different from the characteristics in the outer region's 34 set of characteristics (S3). Also in this example, the outer region's 34 set of characteristics (S3) may also be substantially similar to the inner region's 32 set of characteristics (S1).

Figure 10:
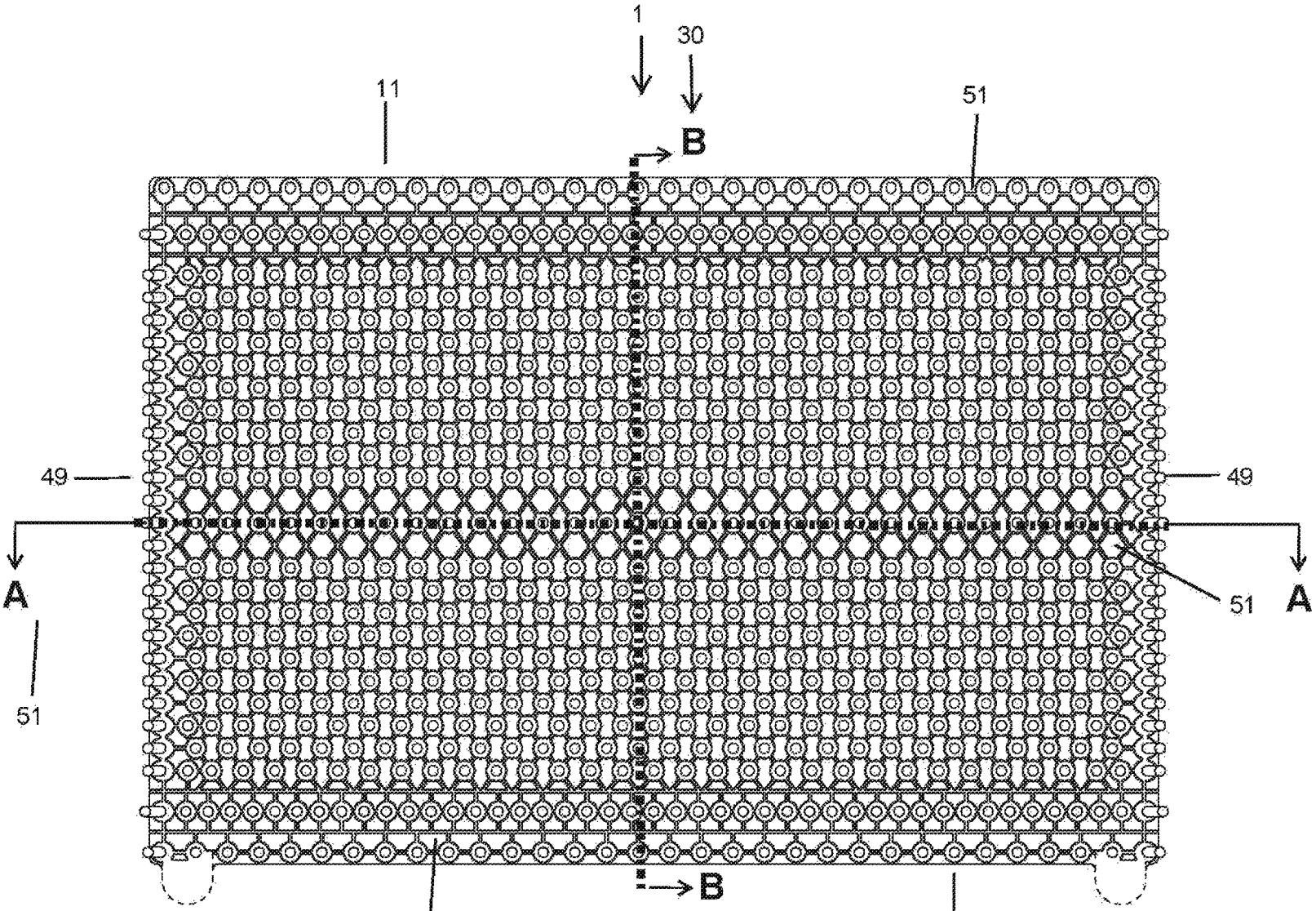
FIG. 10 is top view of the block's bristle side depicting an exemplary embodiment having no bristle free zone.

The figures also illustrate different organizations/patterns of tufts 41 (and sites 31) within each of the Regions. For example, FIG. 4, FIG. 6*a* and FIG. 10 illustrate how tufts 41 may be arranged in a non-staggered or staggered pattern, respectively. It will be appreciated, however, that other patterns may be utilized instead in the various Regions.

It will be recognized that each Region of tufts is characterized/defined by a set of characteristics/traits/variables. Generally speaking, these characteristics/variables include one or more of the following: the type of bristle utilized in a Region; whether a Region contains more than one type of bristle/tuft of how a tuft of bristles is arranged formed; how the bristles/tufts are mounted to the bristle side 30; the bristle material; bristle/tuft geometries and dimensions; bristle/tuft surface finish; bristle/tuft's arrangement, orientation, pattern in a Region; or any combination thereof. Any grouping of these characteristics/traits/variables in a region may be considered a set of characteristics. Also, it will be appreciated that the foregoing is a non-limiting list of characteristics/traits/variables, and any others may be utilized to define a Region's set of characteristics. Moreover, it will be appreciated that the foregoing characteristics/traits/variables included in any Region's set of characteristics are fully customizable, so that each Region may be designed to have any number of variables/traits in its set of characteristics.

The figures also illustrate how tufts 41 (and their corresponding sites 31) may be flared/oriented within any Region. For example, FIGS. 4 and 6*a* depict an optional embodiment where (i) the short bristles tufts 43 within the inner region 32 are staggered (see FIG. 6*a*) or non-staggered (see FIG. 4) and generally perpendicular to the bottom side 30, except along side edges 13 and 14 where there are rows of flared side tufts 49; (ii) the long bristle tufts 46 in intermediate region 33 are crimped and generally perpendicular to bottom side 30, except for the tufts 46 along side edges 13 and 14, where such tufts 46 may be flared similar to the rows of flared side tufts 49; and (iii) the short bristle tufts 43 of the outer region 34 are generally perpendicular; however, some of which may be flared, for example, along leading side 11 (see leading row of flared tufts 48). As illustrated in FIGS. 8*a*-8*e*, the configuration/orientation of tuft sites 31 disposed in any tuft Region on bristle side 30 may vary depending on the arrangement and orientation of the tuft 41 intended to be mounted therein.

As mentioned above, each Region is comprised of tufts having a set characteristics. Two or more tuft Regions may share the same set of characteristics, or all Regions may have different sets of characteristics. For example, inner region 32 and outer region 34 may comprise substantially the same type and pattern of tufts 41 and, therefore, their tufts 41 have substantially the same set of characteristics. In another example, inner region 32 has a first set of characteristics S1, intermediate region 3 has a second set of characteristics S2, and outer region 34 has a third set of characteristics S3, where S1, S2, and S3 are all different; however, it will be appreciated that any two of S1, S2, and S3 may be equal. The following example discusses how S1, S2, and S3 may be selected so as to create brush head 1.

Figure 9:
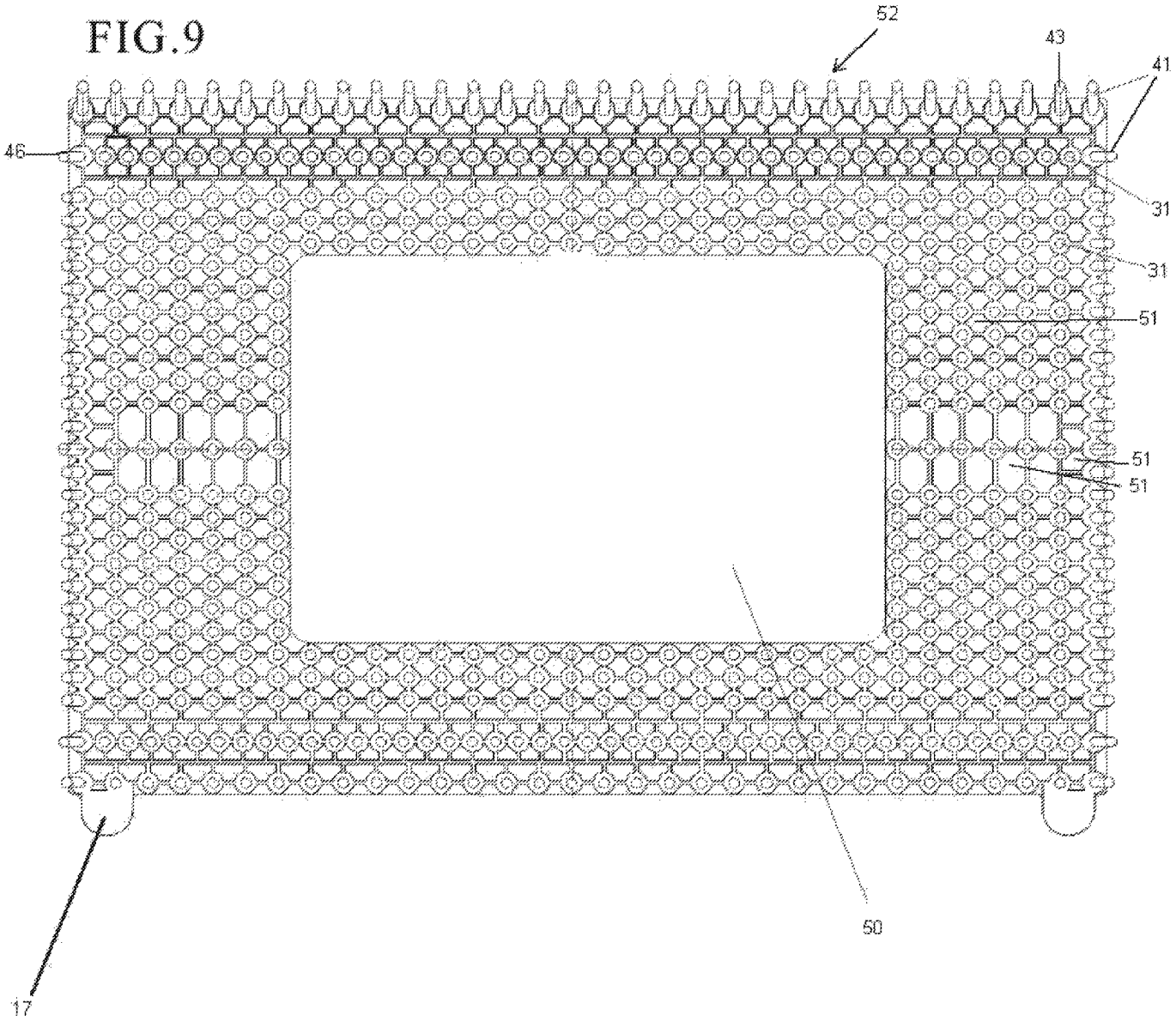
FIG. 9 is a top view of the block's bristle side depicting an exemplary arrangement and pattern of recesses and tuft sites.

FIG. 4 and FIGS. 6*a*-6*c* exemplify embodiment of how the Regions are disposed on bristle side 30 of brush head 1. Here, inner region 32 is located on and (straddles or is) divided by a reference axis, which is depicted as central axis A-A in FIG. 4. In this example, axis A-A happens to divide the length 15 of block in equal halves and, therefore, axis A-A is sometimes referred to as a central axis; however, the reference axis by utilized to locate and place the Regions need not be a "central axis." Here, inner region 32 largely comprises a plurality of polypropylene short bristle tufts 43, oriented generally perpendicular to the surface of bristle side 30, and arranged in rows along the width of the block 10. These tufts 43 have a trim height 44 (see FIG. 6*c*), and the rows of tufts 43 may be staggered (as shown in FIGS. 6*a* and 10), un-staggered (as depicted in FIGS. 4 and 9), or be of any other arrangement/pattern. In the examples presented herein, inner region 32 is designed to provide upright support (without bristle 40 deformation) for brush head 1 and any machine mounted thereto. Therefore, regardless of whether the rows of tufts are staggered, un-staggered, or of some other pattern, tufts 43 should be balanced throughout the Region (e.g., in FIGS. 4, 6*a*, and 10, tufts 43 are balanced with respect to either axis A-A or B-B and therefore balanced throughout the Region). Such a balanced tuft arrangement ensures that the brush head 1 wears evenly and that any machine mounted thereto is maintained in an upright position. Further, the bristle sites 31 (i.e., sites 31S) within inner region 32 are designed to accommodate and receive tufts 43. The foregoing generally comprises the first set of characteristics (S1) accompanying inner region 32.

Continuing with this example, the illustrated block 10 also includes intermediate region 33, which is located outside/outbound of inner region 32 and straddles (or is divided by) the inner region 32. Here, intermediate region 33 comprises two rows of crimped nylon long bristle tufts 46. Tufts 46 are oriented generally perpendicular to the surface side 30 and have trim height 47. Also in this embodiment, the two tuft 46 rows are located on opposing sides of inner region 32. Thus, this intermediate region 33 embodiment comprises one row of long bristle tufts 46 disposed on opposing sides of inner region 32. Importantly, the bristle sites 31 (i.e., sites 31L) within intermediate region 33 are designed to accommodate and receive tufts 46. The foregoing generally comprises the second set of characteristics (S2) accompanying intermediate region 33, which, in this example, at least one of which (i.e., bristle type, length, surface finish, etc.) is substantially different than S1.

Still continuing with this example, the illustrated block 10 also includes outer region 34, which is located outside/outbound of the intermediate region 33, and straddles (or is divided by) the intermediate region 33. In the illustrated examples, outer region 34 comprises two rows of polypropylene short bristle tufts 43. As with the inner region 32, the outer region's 34 short bristle tufts have trim height 44 and extend generally perpendicular from bristle side 30. As with the intermediate region 33, each row of outer region tufts 43 is disposed on an opposing side of intermediate region 33 so that there is one row of short bristle tufts 43 bordering opposing side of intermediate region 33. In this example, outer region 34 also provides upright support (without bristle 40 deformation) for brush head 1 and any machine mounted thereto. Therefore, regardless of how the rows of tufts 43 are organized/patterned, tufts 43 should be balanced throughout the Region (e.g., in FIG. 4, tufts 43 are balanced with respect to either axis A-A and therefore balanced throughout the Region). Such balanced tuft 43 arrangement will ensure that a floor machine does not wobble when mounted to bristle head 1 in an upright position. Further, the bristle sites 31 (i.e., sites 31S) within outer region 34 are designed to accommodate and receive tufts 43. The foregoing generally comprises the third set of characteristics (S3) that accompany outer region 34 and, in some embodiments, may be substantially similar to those of the inner region 32 (i.e., S3 and S1 are substantially similar).

It will be appreciated, however, that the sets of characteristics (i.e., S1, S2, and S3) may be different from those exemplified above. First inner region 32 may include the following optional features: (i) a row of crimped, nylon bristle tufts 46 (with trim height 47) extending along axis A-A in a generally perpendicular direction from bottom surface 30 and (ii) side rows of flared bristle tufts 49 disposed along portions of inner region 32 that border the block's 10 periphery 18 (e.g., at side edges 13 and 14), and comprise either short tufts 43 and/or long bristles tufts 47. Where utilized, the characteristics and details of these and other optional features may be included in the inner region's first set of characteristics S1. It will be appreciated by one skilled in the art, however, the foregoing is not an exhaustive listing of optional features.

Intermediate region 33 may also include optional features. For example, the intermediate region's 33 tufts 41 located proximate to the block's 10 periphery (i.e., at side edges 13 and 14) may be flared away from the block 10 (e.g., at flared side tufts 49). Further, intermediate region 33 may have more than one row of tufts 41 on each side of inner region 32, and their placement on either side of inner region 32 need not be balanced (so long as the overall bristle 40/tuft 41 arrangement on bristle side 30 is balanced). Moreover, intermediate region may optionally comprise rows short bristles 42 and/or tufts 43 in addition to its long tuft 46 rows. Where utilized, the characteristics and details of these and other optional features may be included in the second set of characteristics S2 that accompany the intermediate region 33. It will be appreciated by one skilled in the art, however, the foregoing is not an exhaustive listing of optional features.

Lastly, outer region 34 may also include optional features. For example, outer region 34 may more than one row of bristles 40/tufts 41 on each side of intermediate region 33. Also, outer region 34 may optionally include rows long bristles 45 and/or tufts 46 (in addition to short tufts 43), and these rows may or may not be staggered with respect to neighboring rows inside or outside of the outer region 34. Further, outer region 34 may optionally include flared bristles 40 or tufts 41 as discussed above. For example, the segments of the outer region 34 that border the block's 10 periphery 18 may include rows of bristles 40 or tufts 41 that are flared, such as a leading row of flared bristle tufts 48 and/or side rows of flared bristle tufts 49. Where utilized, the characteristics and details of these and other optional features may be included in the third set of characteristics S3 accompanying the outer region 34. It will be appreciated by one skilled in the art, however, the foregoing is not an exhaustive listing of optional features.

It will be appreciated that any of the foregoing characteristics, features, or variables (optional or otherwise) may be mix and matched throughout any of the regions.

Figure 7:
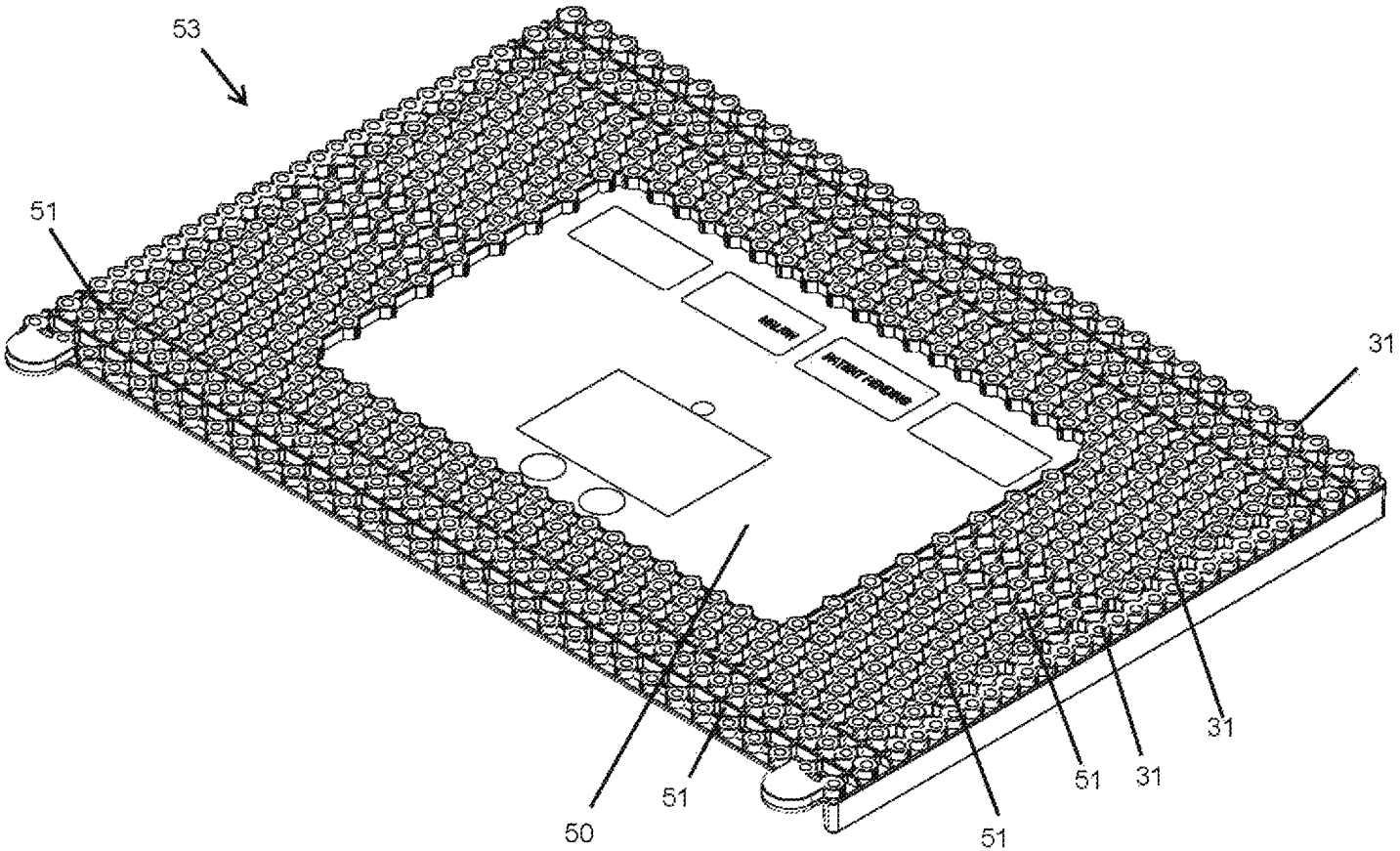
FIG. 7 is an isometric view of the block's bristle side without bristle tufts, depicting an exemplary arrangement and pattern of recesses and tuft sites.

Turning now to FIGS. 7-9, brush head 1 may also include one or more bristle-free zones, such as bristle-free zone 50. Bristle-free zone 50 is located inside the block's 10 periphery 18 on its bottom side 30, and the illustrated examples depict bristle-free zone 50 being located within inner region 32. Bristle free zone 50 may have varying dimensions. In one example, it is rectangular and 284.6 mm (11.205 inches) wide by 188 mm (7.402 inches) in length. However, it will be appreciated that bristle-free zone 50 may have other dimensions and may be used to adjust brush head 1 to a desired weight.

It will also be appreciated that bristle-free zone 50 may be disposed elsewhere on bottom side 30, so long as bristles 40 are disposed in a balanced arrangement, as discussed above. Moreover, it will be appreciated that bristle-free zone 50, in other embodiments, may be a through hole so as to expose the bottom mounting plate of a floor machine. In the illustrated embodiments, a single rectangular bristle-free zone 50 is utilized; however, it will be appreciated any number of bristle free zones with any number of similar or differing geometries may be utilized. For example, bristle-free zone 50 may instead be circular or oval shaped. Alternatively, bristle free zone 50 may comprise several empty zones of the same or different geometries.

Moreover, block 10 need not include a bristle-free zone 50; it is an optional feature. For example, FIG. 10 depicts another example where brush head 1 does not include a bristle-free zone. This example also demonstrates how various bristle configurations (i.e., flared or not flared) may be utilized. For example, FIG. 10 depicts an exemplary bristle configuration where the rows of bristles along side edges 16 and 18 are flared (i.e., side edge rows of flared bristles 49), but where the bristles 40 along leading edge 11 and trailing edge 12 are not flared. It will be appreciated, however, that this is merely one non-limiting example and any number of other bristle 40 configurations (i.e., flared or not flared) may be utilized as discussed above. Thus, in other embodiments of brush head 1 without bristle free zone 50, the brush head 1 may contain (i) a leading row of flared bristles 48 in addition to the side edges rows of flared bristles 49, (ii) a leading row of flared bristles 48 but no side edges rows of flared bristles 49, or (iii) no flared bristles 40 whatsoever. Moreover, these embodiments may be further modified by flaring the bristles 40 along trailing edge 12 (not pictured); however, such modification is optional.

Figures 8A, 8B, 8C, 8D, 8E:
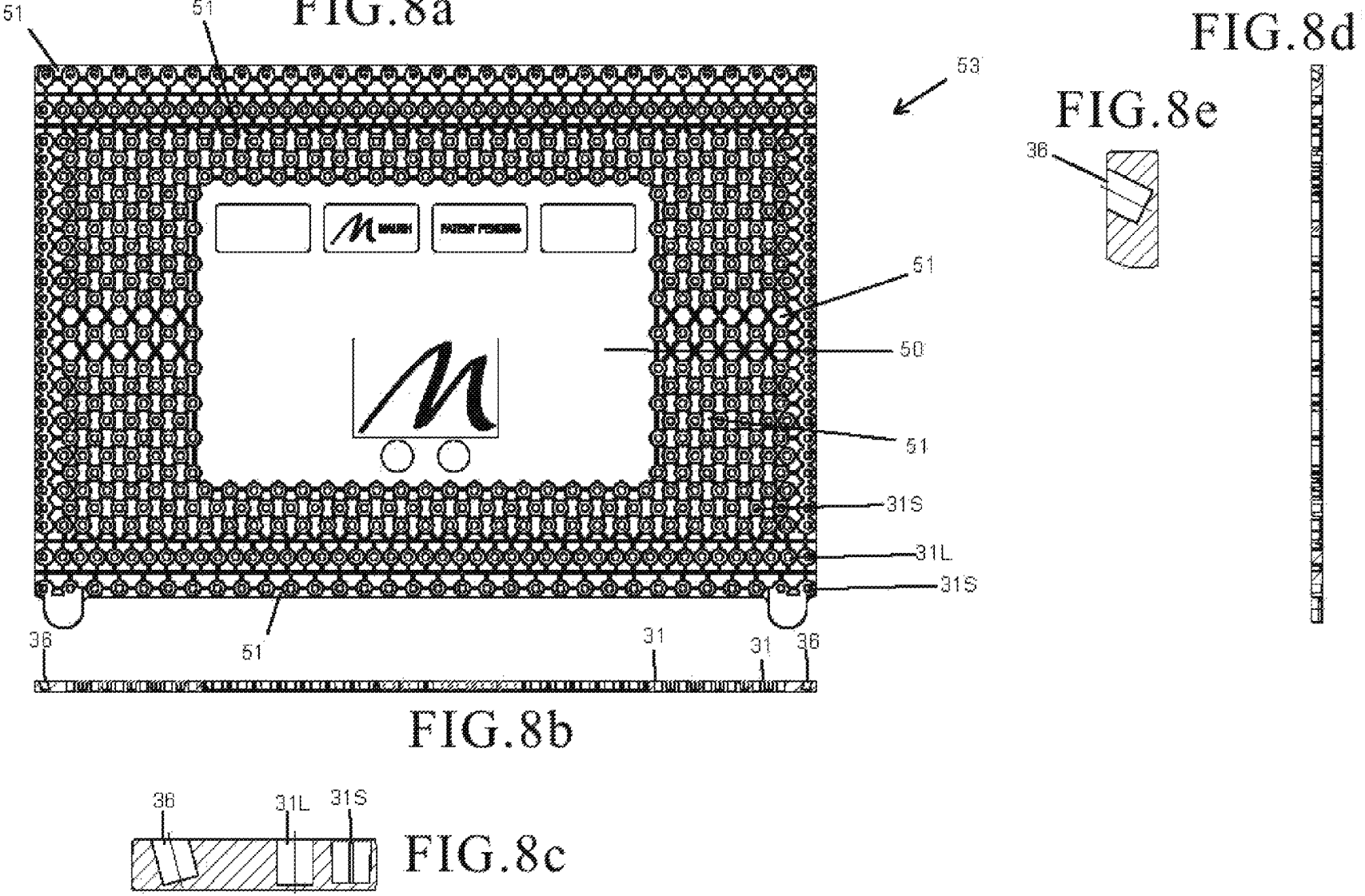
FIG. 8*a* depicts a top view of the block's bristle side.
FIG. 8*b* is a side view of the block along axis A-A.
FIG. 8*c* is a detailed view of FIG. 8*b* depicting an exemplary orientation of the tuft sites.
FIG. 8*d* is a side view of the block along axis B-B.
FIG. 8*e* is a detailed view of FIG. 8*d* depicting an exemplary orientation of a tuft site along the block's leading edge. These renderings depict an exemplary arrangement and pattern of recesses and tuft sites.

The figures also depict brush head 1 comprising a plurality of recesses/voids 51 disposed on bottom side 30. As best exemplified in FIGS. 7-10, recesses 51 may be disposed in between tuft sites 31, and these recesses 51 and sites 31 may be arranged in any number of patterns or configurations. For example FIG. 9 depicts sites 31 and recesses 51 being arranged in an in-line non-staggered pattern 52. FIGS. 7, 8*a*, and 10, on the other hand, depict sites 31 (including flared sites 36 and sites 31L and 31S) and recesses 51 being arranged in a honey-comb like arrangement 53. FIG. 10 also depicts sites 31 and recesses 51 being arranged staggered or honey-comb like arrangement 53, but where bristle side 30 does not include a bristle free zone. It will be appreciated, however, that any other arrangement, pattern, or configuration of recesses 51 and sites 31 (including sites 31L, 31S, and 36) may be utilized so long as block 10 has sufficient structural strength and rigidity so as to not fracture or otherwise fail during operation.

Any publications cited herein are indicative of the level of skill of those skilled in the art to which the presently described subject matter pertains. All of these publications, if any, are hereby incorporated by reference herein to the same extent as if each individual publication were specifically and individually indicated as being incorporated by reference.

While principles and modes of operation have been explained and illustrated pith regard to particular embodiments, it must be understood, however, that this may be practiced otherwise than as specifically explained and illustrated without departing from its spirit or scope.

PART LIST

A-A Primary reference central axis
B-B central axis
1 Brush Head
10 Block
11 leading edge
12 trailing edge
13, 14 opposing side edges
16 width of the block
15 length of block
17 [removal] tab
18 periphery
20 top side
21 mating surface
22 series of loop (aka Velcro)
30 bottom side
31 tuft holes/sites
31L long tuft sites
31S short tuft sites
32 inner region with first set of characteristics S1
33 intermediate region with second set of characteristics S2
34 outer region with third set of characteristics S3
35 flared leading tuft sites
36 flared side tuft sites
40 bristles
41 tuft
42 short bristles
43 short bristles tufts
44 short bristles trim height
45 long bristles
46 long bristles tufts
47 long bristles trim height
48 leading row of flared bristles
49 side edge row of flared bristles
50 bristle free zone
51 plurality if recesses
52 in-line (non-staggered) recess arrangement/configuration/pattern
53 honey comb recess arrangement/configuration/pattern

What is claimed is:

1. A floor brush for use with a floor surface machine, the floor brush comprising:

a brush block having a mounting side, a bristle side, and a periphery, the mounting side configured to be attached to the floor surface machine, the periphery including at least a leading edge that is substantially parallel to a primary axis of the brush block, the bristle side having a plurality of bristle tufts, the bristle side further including:

an inner region divided by the primary axis, the bristle tufts of the inner region having a first set of characteristics;

an intermediate region located outbound of and divided by the inner region, the bristle tufts of the intermediate region having a second set of characteristics, where at least one characteristic of the second set of characteristics is different from the first set of characteristics;

an outer region arranged along the leading edge and located outbound of and divided by the intermediate region, the bristle tufts of the outer region having a third set of characteristics; and a plurality of recesses formed into the bristle side of the brush block and arranged between neighboring bristle tufts for reducing weight of the floor brush, wherein the plurality of recesses formed into the bristle side of the brush block are arranged in rows, and wherein the plurality of recesses in each of the rows are in-line with each other or staggered with respect to the plurality of recesses in neighboring rows.

2. The floor brush of claim 1, wherein the brush block has an area greater than about 32,258 square millimeters.

3. The floor brush of claim 1, wherein the brush block has a maximum thickness of about 25 millimeters.

4. The floor brush of claim 1, wherein the floor brush has a maximum weight of about 2.27 kg.

5. The floor brush of claim 1, wherein the bristle side further includes at least one bristle-free zone located interior of the periphery of the block, the bristle-free zone having no bristle tufts.

6. The floor brush of claim 1, wherein the first set of characteristics, the second set of characteristics, and the third set of characteristics each include one or more characteristics selected from the group consisting of bristle length, bristle diameter, bristle surface finish, bristle geometry, bristle shape, bristle material type, bristle orientation, bundle organization, bundle arrangement, bundle pattern, bundle mounting and bundle orientation, or any combination thereof.

7. The floor brush of claim 1, wherein the first set of characteristics of the inner region is substantially the same as the third set of characteristics of the outer region.

8. The floor brush of claim 1, wherein the bristle tufts arranged within the inner region and the outer region remain in a substantially extended orientation when supporting the floor surface machine secured to the mounting side of the brush block.

9. The floor brush of claim 8, wherein the bristle tufts of the inner region and the outer region all remain in a substantially extended orientation when loaded with about 9.07 kg.

10. The floor brush of claim 1, wherein a substantial length of bristle tufts located along the periphery of the brush block are angled to extend outward of the brush block.

11. The floor brush of claim 10, wherein the bristle tufts arranged along the leading edge are angled outward from the brush block.

12. The floor brush of claim 1, wherein the brush block further includes at least one tab member that extends outward from the periphery.

13. The floor brush of claim 1, wherein the bristle tufts of the intermediate region are longer than the bristle tufts of the inner region.

14. The floor brush of claim 13, wherein the bristle tufts of the intermediate region are longer than the bristle tufts of the outer region.

15. The floor brush of claim 14, wherein the outer region of third bristle tufts comprises short bristle tufts.

16. A floor brush for use with a floor surface machine, the floor brush comprising:

a brush block having a mounting side and a bristle side, the bristle side having a plurality of tuft sites for receiving bristle tufts and a plurality of voids formed into the bristle side, the plurality of voids being disposed between neighboring tuft sites; and a plurality of bristle tufts secured within the plurality of tuft sites, wherein the bristle tufts are arranged in different regions, with the bristle tufts of one of the different regions having at least one different characteristic from the bristle tufts of another of the different regions, herein the plurality of voids formed into the bristle side of the brush block are arranged in rows, and the plurality of voids in each of the rows are in-line with each other or the plurality of voids in each of the rows are staggered with respect to the plurality of voids in neighboring rows.

17. A floor brush for use with a floor surface machine, the floor brush comprising:

a brush block having a mounting side and a bristle side, the bristle side having a plurality of tuft sites for receiving bristle tufts and a plurality of voids formed into the bristle side, the plurality of voids being disposed between neighboring tuft sites, wherein the bristle side further includes at least one bristleless region having no tuft sites located interior the bristle tufts; and a plurality of bristle tufts secured within the plurality of tuft sites, wherein the bristle tufts are arranged in different regions, with the bristle tufts of one of the different regions having at least one different characteristic from the bristle tufts of another of the different regions.

18. The floor brush of claim 17, wherein the bristle side includes an inner region, which is divided by a primary axis of brush block, and an intermediate region, which is located outbound of and divided by the inner region, the bristle tufts of the intermediate region being longer than the bristle tufts of the inner region.

19. The floor brush of claim 18, wherein the bristle side further includes an outer region, which is arranged along a leading edge of the brush block and located outbound of and divided by the intermediate region, the bristle tufts of the intermediate region being longer than the bristle tufts of the outer region.

20. The floor brush of claim 17, wherein a substantial length of bristle tufts located along a periphery of the brush block are angled to extend outward of the brush block.

* * * * *